US008367158B2

(12) United States Patent
Uchiyama

(10) Patent No.: US 8,367,158 B2
(45) Date of Patent: Feb. 5, 2013

(54) LIQUID-REPELLENT FILM FORMING METHOD, INKJET HEAD AND INKJET RECORDING APPARATUS

(75) Inventor: Hiroki Uchiyama, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 218 days.

(21) Appl. No.: 12/890,355

(22) Filed: Sep. 24, 2010

(65) Prior Publication Data

US 2011/0074880 A1 Mar. 31, 2011

(30) Foreign Application Priority Data

Sep. 28, 2009 (JP) ..... 2009-222967

(51) Int. Cl.
*B05D 1/18* (2006.01)

(52) U.S. Cl. ..... 427/264; 427/2.31

(58) Field of Classification Search ..... 427/264, 427/2.31, 447, 452, 461, 464, 98.6, 497, 427/97.4, 107, 430.1, 255.7
See application file for complete search history.

(56) References Cited

U.S. PATENT DOCUMENTS 5,372,851 A * 12/1994 Ogawa et al. ..... 427/255.7
2008/0213494 A1* 9/2008 Kimura et al. ..... 427/430.1

FOREIGN PATENT DOCUMENTS

JP 2003-286478 A 10/2003
JP 2008-105231 A 5/2008
JP 2009-029068 A 2/2009

* cited by examiner

*Primary Examiner* — Lamson Nguyen
(74) *Attorney, Agent, or Firm* — Fish & Richardson P.C.

(57) ABSTRACT

The method forms a liquid-repellent film on a surface of a nozzle plate having nozzle apertures through which droplets of liquid are ejected. The method includes: a termination process step of carrying out a hydrogen termination process or a halogen termination process on a surface of a nozzle plate, at least a portion of the surface of the nozzle plate being made of a material containing silicon; and a liquid-repellent film formation step of forming a liquid-repellent film on the surface of the nozzle plate after the termination process step by bringing a liquid-repellent film raw material into contact with the surface of the nozzle plate while applying energy to the surface. Each molecule constituting the liquid-repellent film raw material has an unsaturated carbon bond at an end and has a liquid-repellent functional group. The liquid-repellent film is bonded to the surface of the nozzle plate through silicon-carbon bonds.

12 Claims, 6 Drawing Sheets

LIQUID-REPELLENT FILM FORMING METHOD, INKJET HEAD AND INKJET RECORDING APPARATUS

BACKGROUND OF THE INVENTION

1. Field of the Invention

The present invention relates to a liquid-repellent film forming method, an inkjet head and an inkjet recording apparatus, and more particularly, to technology for forming a liquid-repellent film having liquid-repellent properties on a surface of a nozzle plate having nozzle apertures for ejecting liquid droplets.

2. Description of the Related Art

In a recording head (also referred to as an inkjet head) used in an inkjet recording apparatus, droplets of ink are ejected through nozzles having nozzle apertures in the surface of a nozzle plate, which constitutes an ink ejection surface of the recording head. If the ink has adhered to the surface of the nozzle plate (and in particular, to the periphery of the nozzle apertures), ink droplets subsequently ejected from the nozzles are affected and ejection instabilities occur, for instance, variations arise in the ejection direction of the ink droplets, giving rise to a deterioration in image quality. Therefore, in order to prevent these problems, the surface of the nozzle plate on the ejection side of the nozzle apertures (hereinafter referred to as an "ejection side surface") is coated with a liquid-repellent film.

Various different technologies have been proposed hitherto for forming a liquid-repellent film on the ejection side surface of a nozzle plate.

For example, Japanese Patent Application Publication No. 2003-286478 discloses a liquid-repellent film formed on a nozzle plate and a method of manufacturing same. The liquid-repellent film contains molecules having at least one siloxane bond (—Si—O—) at either end and including a vinyl group and/or an ethynyl group and a benzene ring in the intermediate part, and molecules having a carbon fluoride chain at one end and at least one siloxane bond at the other end, which the two types of molecules together form a polymer. It is considered possible to thereby form the liquid-repellent film having alkali resistant properties.

Japanese Patent Application Publication No. 2009-029068 discloses a method of manufacturing a nozzle plate for a liquid ejection head made of silicon. The nozzle plate is formed with nozzles through which the liquid is ejected, and has a liquid-repellent film on a surface where apertures of the nozzles are arranged. In the manufacturing method, the following steps are carried out successively: a step of preparing a silicon substrate having a silicon oxide film on the surface where the nozzle apertures are arranged; a step of carrying out a chemical activation process for activating the silicon oxide film by removing the surface by chemical reaction in a dry process; a step of carrying out a physical activation process for activating the silicon oxide film by removing the surface by physical breakdown in a dry process; and a step of arranging the liquid-repellent film on the silicon oxide film. It is considered possible to thereby form the liquid-repellent film having durability on the surface where the nozzle apertures are arranged.

Japanese Patent Application Publication No. 2003-286478 is directed to technology for improving the material properties of the liquid-repellent film and improving the durability with respect to alkaline solutions, and Japanese Patent Application Publication No. 2009-029068 is directed to technology for strengthening the bond between the liquid-repellent film and the underlying silicon oxide film by cleaning and activating the surface of the silicon oxide film through carrying out a plasma treatment on the silicon oxide film to remove organic material.

Japanese Patent Application Publication No. 2008-105231 discloses a liquid-repellent film forming method which forms a liquid-repellent film having liquid-repellent properties on the surface of a nozzle plate. The method includes: a first step of forming an underlying layer composed of a plasma polymerization film, on one surface of a nozzle plate; a second step of carrying out an oxidization process on the surface of the underlying layer in a gas atmosphere of a dew point at −40° C. to 20° C., and introducing a hydroxyl group and/or adsorption water; and a third step of forming the liquid-repellent film on the underlying layer on which the oxidization process has been carried out. It is considered possible to thereby form the liquid-repellent film having improved adhesion to the underlying layer and resistance to wear.

However, even if the material properties of the liquid-repellent film are improved as in Japanese Patent Application Publication No. 2003-286478, there is a drawback in that if the processing of the underlying layer is incomplete, then sufficient bonding sites (hydroxyl groups: OH groups) are not created. Then, the bonding between the liquid-repellent film and the underlying layer is not sufficient, and the film properties are declined. Moreover, even if cleaning and surface activation is carried out by plasma treatment of the underlying layer only as in Japanese Patent Application Publication No. 2009-029068, there is a drawback in that sufficient reaction sites are not created on the surface and a high-density liquid-repellent film having sufficient resistance to alkalis is not obtained.

Over and above the aforementioned drawbacks, a problem that is common to the technologies in Japanese Patent Application Publication Nos. 2003-286478 and 2009-029068 is the fact that the liquid-repellent film is bonded to the nozzle plate through siloxane bonds, which are liable to be hydrolyzed in liquids containing OH groups, such as water or aqueous solutions containing alkalis. Consequently, if alkaline ink droplets, for example, are ejected through the nozzle apertures of the nozzle plate, as in the inkjet head, then the liquid-repellent film in the related art is liable to be erased by contact with the ink, and it is thus not possible to improve resistance to alkalis.

Furthermore, there is also technology which improves film density by increasing the film thickness, and increases the overall lifespan of the film, even if deterioration occurs, as in the plasma polymerization film in Japanese Patent Application Publication No. 2008-105231; however, this leads to increase in raw material quantity and costs, and moreover, since the film is essentially based on siloxane network, then it is also not possible to improve resistance to alkalis.

SUMMARY OF THE INVENTION

The present invention has been contrived in view of these circumstances, an object thereof being to provide a liquid-repellent film forming method, an inkjet head and an inkjet recording apparatus, whereby it is possible to form, on the surface of a nozzle plate, a liquid-repellent film having high resistance to various types of liquids, for example, liquids containing alkaline, acidic and neutral water-soluble components, as well as preventing the erasure of the liquid-repellent film even if droplets of alkaline liquid, for example, are ejected though nozzle apertures formed in the nozzle plate, and hence the liquid droplet ejection stability, and the maintenance properties of the nozzle plate can be improved dramatically.

In order to attain the aforementioned object, the present invention is directed to a method of forming a liquid-repellent film on a surface of a nozzle plate having nozzle apertures through which droplets of liquid are ejected, the method comprising: a nozzle plate preparation step of preparing a nozzle plate, at least a portion of a surface of the nozzle plate being made of a material containing silicon; a termination process step of carrying out one of a hydrogen termination process and a halogen termination process on the surface of the nozzle plate; and a liquid-repellent film formation step of forming a liquid-repellent film on the surface of the nozzle plate after the termination process step by bringing a liquid-repellent film raw material into contact with the surface of the nozzle plate while applying energy to the surface of the nozzle plate, each molecule constituting the liquid-repellent film raw material having an unsaturated carbon bond at an end and having a liquid-repellent functional group, the liquid-repellent film being bonded to the surface of the nozzle plate through silicon-carbon bonds.

Here, "at least a portion of a surface of the nozzle plate being made of a material containing silicon" is not limited to cases where the whole of the nozzle plate is made of the material containing silicon and also includes cases where the surface of the nozzle plate is made of the material containing silicon. Moreover, this is not limited to cases where the whole of the surface of the nozzle plate is made of the material containing silicon, and it is possible to form only a portion of the surface of the nozzle plate from the material containing silicon.

According to this aspect of the present invention, since the surface of the nozzle plate made of the material containing silicon and having the nozzle apertures through which droplets of liquid are ejected is coated with the liquid-repellent film based on silicon-carbon bonding, which has high resistance to liquids of various kinds, such as liquids including alkaline, acidic and neutral water-soluble components, and non-water-soluble liquids, then the liquid-repellent film is not erased even when alkaline liquid droplets, for instance, are ejected through the nozzle apertures formed in the nozzle plate. Moreover, since the liquid-repellent film based on silicon-carbon bonds is a monolayer having high resistance to liquids of various types, then the smoothness of the liquid-repellent film can be raised and liquid droplets become less liable to adhere to the periphery of the nozzle apertures, thereby further improving the liquid droplet ejection stability. Thus, it is possible to improve the ejection stability of the liquid droplets ejected through the nozzle apertures, as well as improving the maintenance characteristics of the nozzle plate. Furthermore, it is possible to reduce the effects to dimensional accuracy of the nozzle apertures, by forming the liquid-repellent film in molecular film.

Consequently, the above-described aspect of the present invention is optimal as a method of forming a liquid-repellent film on the ejection side surface of the nozzle plate in the inkjet head.

In the above-described aspect of the present invention, two methods, the hydrogen termination process and the halogen termination process, can be selected in the termination process step. The hydrogen termination process is more desirable from the viewpoint of the ease of forming the liquid-repellent film and preventing contamination. Furthermore, the hydrogen termination process can be a wet process in which the nozzle plate is immersed in a solution containing hydrofluoric acid or ammonium fluoride, or a dry process in which the nozzle plate is plasma treated with a plasma of hydrogen. The dry process is more desirable from the viewpoint of preventing contamination.

Preferably, in the liquid-repellent film formation step, heat, ultraviolet light or visible light is applied to the surface of the nozzle plate as the energy.

By applying the energy to the surface of the nozzle plate which has undergone the termination process, hydrogen atoms (in the case of hydrogen termination) or halogen atoms (in the case of halogen termination) are drawn out from the surface of the nozzle plate, and silicon radicals (i.e., dangling bonds) for radical reaction with carbon atoms of the liquid-repellent film raw material having unsaturated carbon bonds to form silicon-carbon bonds are generated efficiently.

Preferably, the method further comprises a cleaning step of removing impurities from the surface of the nozzle plate before the termination process step. This is because the termination process is made more efficient by removing impurities from the surface of the nozzle plate.

Preferably, in each molecule constituting the liquid-repellent film raw material, the liquid-repellent functional group is located on an end opposite to the end having the unsaturated carbon bond. Hence, the liquid-repellent functional group is located at the surface of the liquid-repellent film (the surface opposite to the nozzle plate side), and therefore the liquid-repellent properties can be improved.

Preferably, in each molecule constituting the liquid-repellent film raw material, the liquid-repellent functional group includes a fluorocarbon straight chain or a fluorocarbon branch chain.

For example, the liquid-repellent film raw material can include perfluorohexyl ethylene; 1H, 1H, 2H-heptadecafluoro-1-decene; or 3,3,4,4,5,5,6,6,6-nonafluoro-1-hexene.

Preferably, the nozzle plate is provided on an inkjet head which ejects droplets of ink.

In order to attain the aforementioned object, the present invention is also directed to an inkjet head comprising a nozzle plate having nozzle apertures through which droplets of liquid are ejected from an ejection side surface of the nozzle plate, wherein: at least a portion of the ejection side surface of the nozzle plate is made of a material containing silicon; and the ejection side surface of the nozzle plate is coated with a liquid-repellent film which is bonded to the ejection side surface through silicon-carbon bonds.

According to this aspect of the present invention, the surface of the nozzle plate is coated with the liquid-repellent film bonded to the surface of the nozzle plate through silicon-carbon bonds and thereby having high resistance to liquids of various kinds, such as liquid containing alkaline, acidic and neutral water-soluble components, as well as non-water-soluble liquids. Consequently, the liquid-repellent film is not erased, even if alkaline liquid droplets, for example, are ejected through the nozzle apertures formed in the nozzle plate.

Therefore, the ejection stability of the ink droplets ejected through the nozzle apertures, and the maintenance characteristics of the nozzle apertures can be improved, and if the inkjet head of this aspect of the present invention is used in an inkjet recording apparatus, then the ejection stability is improved, for instance, the ejection direction of the ink droplets is stable.

Preferably, each molecule constituting the liquid-repellent film has a liquid-repellent functional group and is terminated at an end with a carbon atom bonding to a silicon atom on the ejection side surface of the nozzle plate.

Preferably, the liquid-repellent functional group contains fluorine.

Preferably, the liquid-repellent functional group includes a fluorocarbon straight chain or a fluorocarbon branch chain.

For example, the liquid-repellent film can be formed from a raw material including perfluorohexyl ethylene; 1H, 1H, 2H-heptadecafluoro-1-decene; or 3,3,4,4,5,5,6,6,6-nonafluoro-1-hexene.

In order to attain the aforementioned object, the present invention is also directed to an inkjet recording apparatus comprising the above-described inkjet head.

According to this aspect of the present invention, the inkjet recording apparatus is able to prevent decline in image quality due to instability in the ejection of the ink.

According to the present invention, it is possible to form a liquid-repellent film having high resistance to liquids of various kinds, such as liquids containing alkaline, acidic and neutral water-soluble components, as well as non-water-soluble liquids, on the surface of a nozzle plate, and the liquid-repellent film is not erased even if alkaline liquid droplets, for example, are ejected through nozzle apertures formed in the nozzle plate. Moreover, since it is possible to form the liquid-repellent film as a monolayer having high resistance to liquids of various kinds, then the smoothness of the liquid-repellent film can be raised and liquid droplets become less liable to adhere to the periphery of the nozzle apertures, thus further improving the liquid droplet ejection stability. Thus, it is possible to improve the liquid droplet ejection stability and the maintenance characteristics of the nozzle plate. Furthermore, by forming the liquid-repellent film as a monolayer, it is possible to reduce the effects to dimensional accuracy of the nozzle apertures.

Therefore, if the present invention is used in an inkjet head of an inkjet recording apparatus, it is possible to improve image quality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

An embodiment of the present invention is described below with respect to an example in which a liquid-repellent film is formed on a nozzle plate of an inkjet head which ejects ink droplets; however, the present invention is not limited to an inkjet head and can also be applied to all cases of forming a liquid-repellent film on a nozzle plate which ejects liquid droplets of various types containing water-soluble components, such as alkaline or acid liquids, or neutral liquids, or the like.

General Configuration of Inkjet Recording Apparatus

Figure 1:
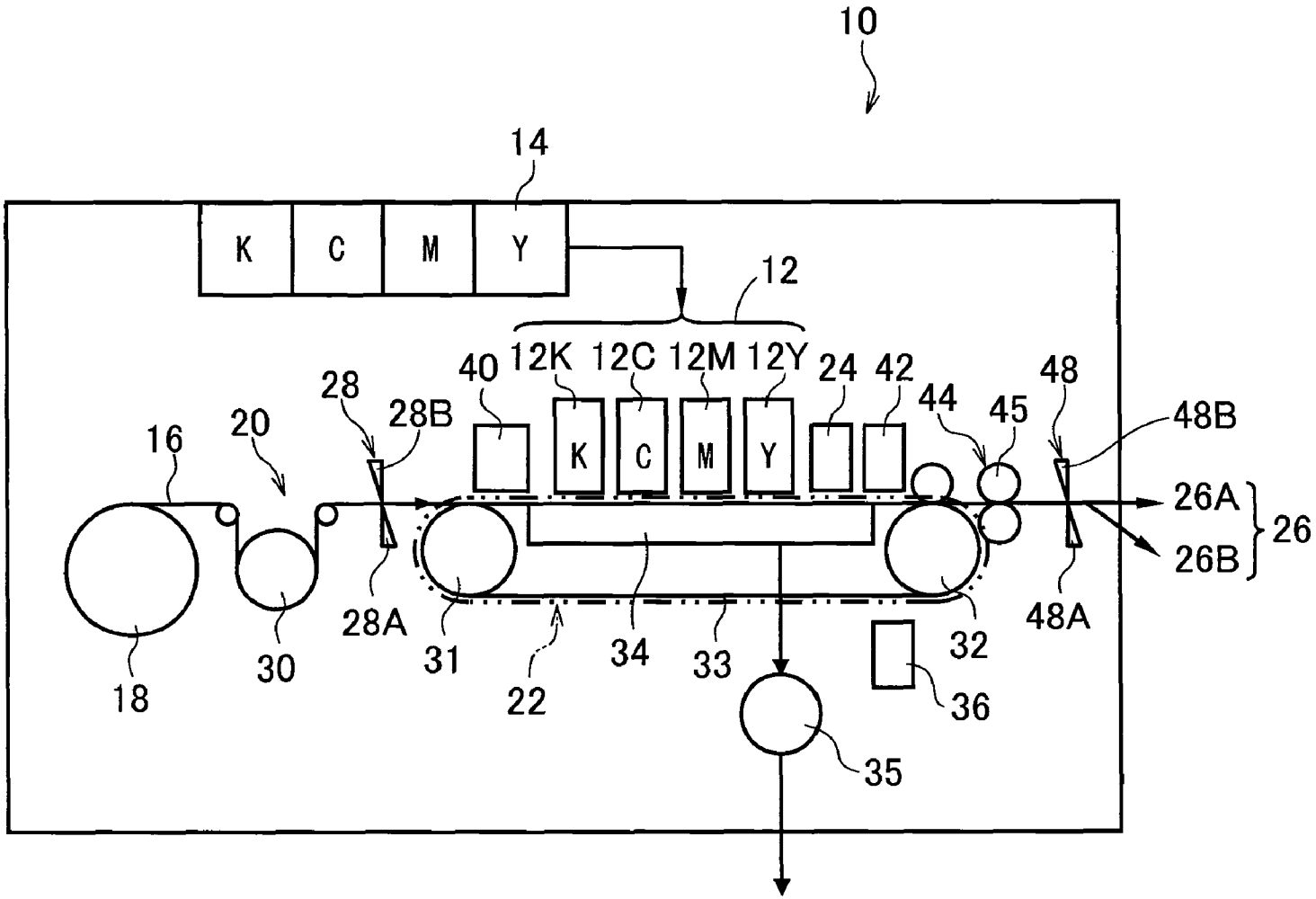
FIG. 1 is a general schematic drawing showing a general view of an inkjet recording apparatus.

FIG. 1 is a general configuration diagram of an inkjet recording apparatus according to an embodiment of the present invention. As illustrated in FIG. 1, the inkjet recording apparatus 10 includes: a printing unit 12 having a plurality of inkjet heads (hereafter, also simply called "heads") 12K, 12C, 12M, and 12Y provided for the respective ink colors of black (K), cyan (C), magenta (M) and yellow (Y); an ink storing and loading unit 14 for storing inks of K, C, M and Y to be supplied to the printing heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as illustrated in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effect.

A roller nip conveyance mechanism, in place of the suction belt conveyance unit 22, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
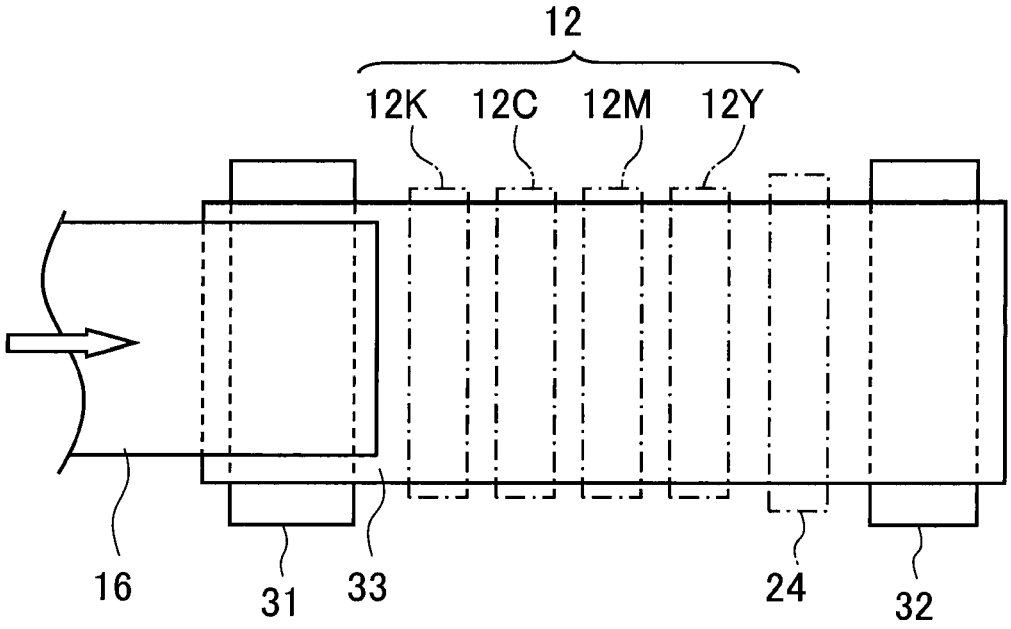
FIG. 2 is a principal part plan diagram of the periphery of a print unit of the inkjet recording apparatus in FIG. 1.

The printing unit 12 is a so-called "full line head" in which a line head having a length corresponding to the maximum paper width is arranged in a direction (main scanning direction) that is perpendicular to the paper conveyance direction (sub scanning direction). Each of the printing heads 12K, 12C, 12M, and 12Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The printing heads 12K, 12C, 12M, and 12Y are arranged in the order of black (K), cyan (C), magenta (M) and yellow (Y) from the upstream side, along the feed direction of the recording paper 16 (hereinafter referred to as the "sub-scanning direction"). A color image can be formed on the recording paper 16 by ejecting the inks from the printing heads 12K, 12C, 12M, and 12Y, respectively, onto the recording paper 16 while conveying the recording paper 16.

By adopting the printing unit 12 in which the full line heads covering the full paper width are provided for the respective ink colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a head reciprocates in a direction (the main scanning direction) orthogonal to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added. Furthermore, there are no particular restrictions of the sequence in which the heads of respective colors are arranged.

As illustrated in FIG. 1, the ink storing and loading unit 14 has tanks for storing the inks of K, C, M and Y to be supplied to the heads 12K, 12C, 12M, and 12Y, and the tanks are connected to the heads 12K, 12C, 12M, and 12Y by means of channels, which are omitted from figures. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined The ejection determination includes measurement of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressing unit 44 is disposed following the post-drying unit 42. The heating/pressing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Structure of Head

Next, the structure of heads 12K, 12C, 12M and 12Y will be described. The heads 12K, 12C, 12M and 12Y of the respective ink colors have the same structure, and a reference numeral 50 is hereinafter designated to any of the heads.

Figure 3A:
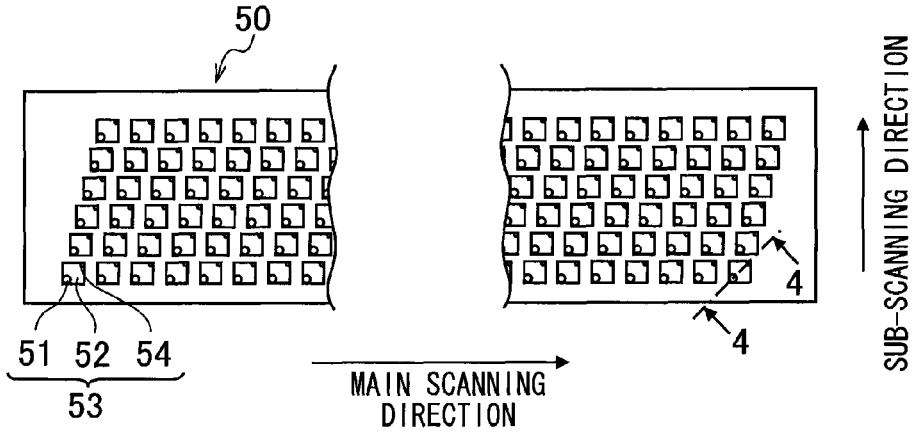
FIGS. 3A to 3C are plan view perspective diagrams showing embodiments of the composition of a head.
Figure 3B:
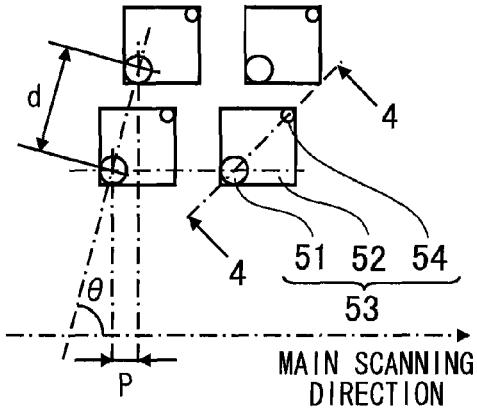
Figure 3C:
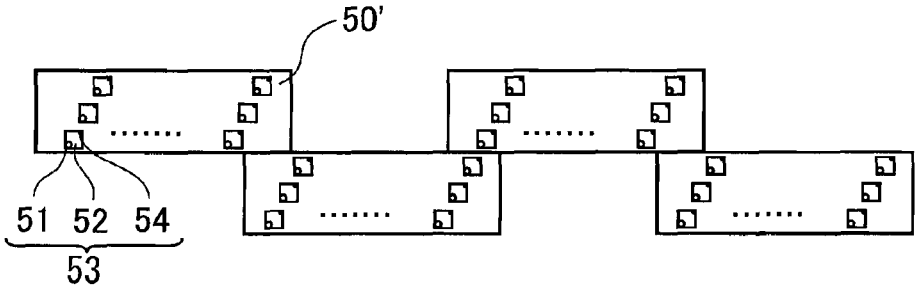
Figure 4:
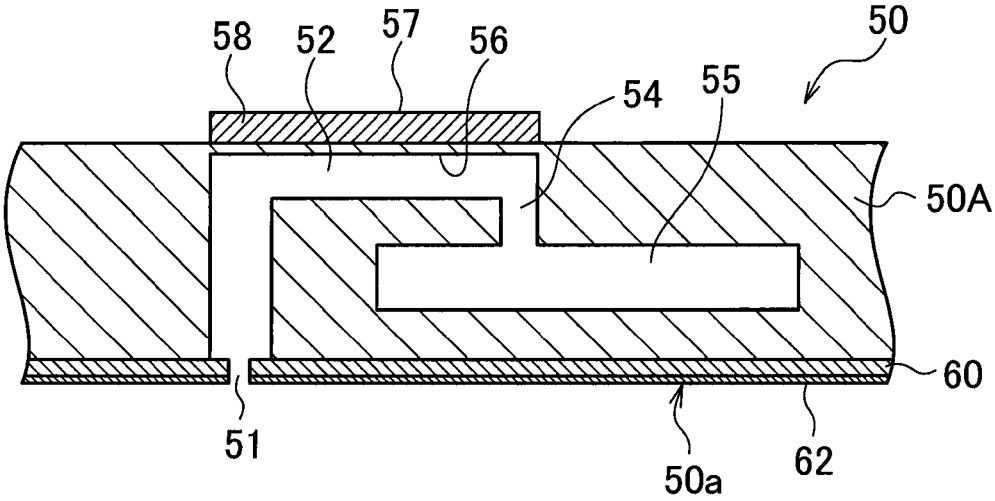
FIG. 4 is a cross-sectional diagram along line 4-4 in FIGS. 3A and 3B.

FIG. 3A is a plan perspective diagram showing an example of the structure of a head 50, and FIG. 3B is a partial enlarged diagram of same. Moreover, FIG. 3C is a plan view perspective diagram showing a further example of the structure of the head 50. FIG. 4 is a cross-sectional diagram showing the composition of an ink chamber unit (a cross-sectional diagram along line 4-4 in FIGS. 3A and 3B).

The nozzle pitch in the head 50 should be minimized in order to maximize the density of the dots formed on the surface of the recording paper. As illustrated in FIGS. 3A and 3B, the head 50 according to the present embodiment has a structure in which a plurality of ink chamber units 53, each having a nozzle aperture 51 serving as an ink droplet ejection aperture, a pressure chamber 52 corresponding to the nozzle aperture 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in a direction substantially perpendicular to the paper conveyance direction is not limited to the example described above. For example, instead of the configuration in FIG. 3A, as illustrated in FIG. 3C, a line head having nozzle rows of a length corresponding to the entire width of the recording paper 16 can be formed by arranging and combining, in a staggered matrix, short head blocks (head chips) 50' having a plurality of nozzle apertures 51 arrayed in a two-dimensional fashion. Furthermore, although not shown in the drawings, it is also possible to compose a line head by arranging short heads in one row.

As shown in FIG. 4, the nozzle apertures 51 are formed in a nozzle plate 60, which constitutes an ink ejection surface 50*a* of the head 50 and is bonded to a head main body 50A. The nozzle plate 60 is made of a material containing silicon (hereinafter referred to as a "silicon material"), such as Si, $SiO_2$, SiN, quartz glass, and the like. The ink ejection surface 50*a* of the nozzle plate 60 is coated with a liquid-repellent film 62 having liquid-repellent properties with respect to the ink. The liquid-repellent film 62 prevents the ink from adhering to the ejection surface 50*a* of the nozzle plate 60, and in particular to the periphery of the nozzle apertures 51, thereby ensuring stability of the ejection of ink droplets from the nozzle apertures 51.

As described with respect to the related art, the liquid-repellent film in the related art is liable to be hydrolyzed in liquids containing OH groups, such as water, or a water-soluble component having alkaline properties, and if an alkaline ink, for example, is ejected for a long period of time from the nozzle apertures, then there is a problem in that the liquid-repellent film is gradually erased and the ejection stability is impaired. Therefore, in the present embodiment, the nozzle plate 60 is made of the material containing silicon, and the liquid-repellent film 62 that forms silicon-carbon bonds with silicon in the nozzle plate 60 is applied on the surface of the nozzle plate 60 on the ejection side of the nozzle apertures 51. A method of forming the liquid-repellent film 62 according to the present embodiment is described in more detail below.

Referring again to FIG. 4, the head 50 is provided with the pressure chambers 52 correspondingly to the nozzle apertures 51. The pressure chamber 52 is approximately square-shaped in planar form, and the nozzle aperture 51 and a supply port 54 are arranged respectively at either corner on a diagonal of the pressure chamber 52. The pressure chambers 52 are connected to a common flow channel 55 through the supply ports 54. The common flow channel 55 is connected to an ink tank (not shown) serving as an ink supply source. The ink is supplied from the ink tank and distributed to the pressure chambers 52 through the common flow channel 55.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle aperture 51. When the ink is ejected, new ink is supplied to the pressure chambers 52 from the common flow channel 55 through the supply ports 54.

In the present embodiment, the piezoelectric element 58 is used as an ink ejection force generating device which causes ink to be ejected from the nozzle aperture 51 provided in the head 50, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzle apertures 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the recording paper 16 is scanned in the breadthways direction (main scanning direction) of the recording paper 16, thereby performing printing in the breadthways direction, and when one printing action in the breadthways direction has been completed, the recording paper 16 is moved through a prescribed amount in the direction perpendicular to the breadthways direction (the sub-scanning direction), printing in the breadthways direction of the recording paper 16 is carried out in the next printing region, and by repeating this sequence, printing is performed over the whole surface of the printing region of the recording paper 16.

Method of Forming Liquid-Repellent Film

Next, the method of forming the liquid-repellent film according to the present embodiment is described.

Figure 5A:
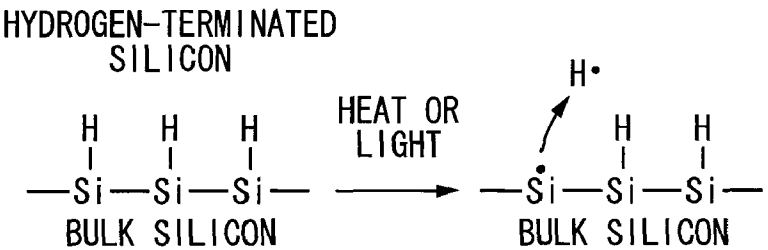
FIGS. 5A and 5B are reaction process diagrams of formation of a liquid-repellent film on a nozzle plate.
Figure 5B:
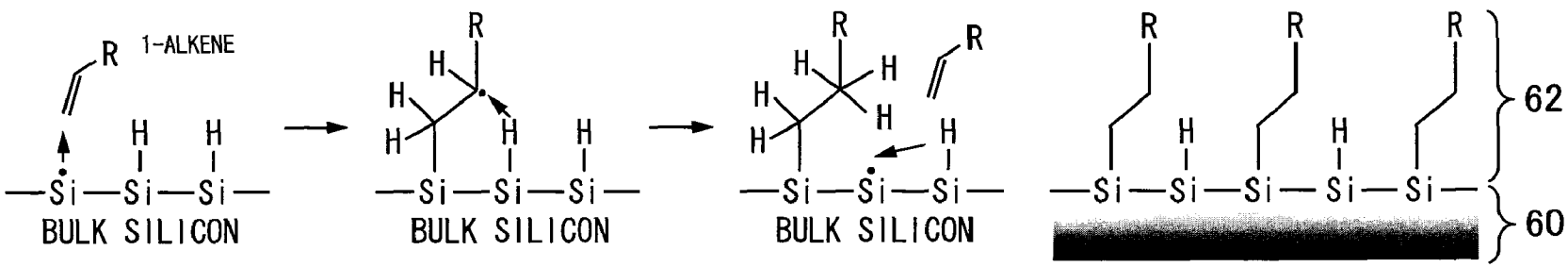

FIGS. 5A and 5B are illustrative diagrams for describing a reaction process in the liquid-repellent film forming method.

The method of forming liquid-repellent film on the nozzle plate 60 made of material containing silicon shown in FIGS. 5A and 5B includes: a cleaning step of removing impurities other than the material of the nozzle plate 60 (examples of the impurities including organic adhering matter, dust, dirt, and the like) from the surface of the nozzle plate 60 on the ejection side of the nozzle apertures 51 (hereinafter referred to as a "nozzle plate surface"); a termination processing step of performing a hydrogen termination process or a halogen termination process on the nozzle plate surface; and a liquid-repellent film forming step of forming the liquid-repellent film 62 which is bonded to the nozzle plate surface through silicon-carbon bonds by bringing liquid-repellent film raw material having an unsaturated carbon bond at an end and also having a liquid-repellent functional group into contact with the nozzle plate surface while applying energy to the nozzle plate surface after the termination process. The details of each step are described hereinafter. In the present embodiment, the whole of the nozzle plate can be made of the material containing silicon; however, it is sufficient that only the nozzle plate surface or a portion thereof is made of the material containing silicon.

<Cleaning Step>

For the step of cleaning the nozzle plate surface, it is suitable to adopt any of the following three methods.

(1) A cleaning step in which the following sub-steps are carried out in sequence: ethanol/ultrasonic cleaning to irradiate ultrasonic waves onto the nozzle plate 60 immersed in an ethanol solution, ultra-pure water/ultrasonic cleaning to irradiate ultrasonic waves onto the nozzle plate 60 immersed in ultra-pure water, and then UV/ozone cleaning, which combines UV (ultraviolet) irradiation and contact with ozone on the nozzle plate 60.

(2) A cleaning step in which the following sub-steps are carried out in sequence: anhydrous toluene/ultrasonic cleaning to irradiate ultrasonic waves onto the nozzle plate 60 immersed in an anhydrous toluene solution, ethanol/ultrasonic cleaning described above, ultra-pure water cleaning to immerse the nozzle plate 60 in ultra-pure water or spray a jet of ultra-pure water onto the nozzle plate 60, and then UV/ozone cleaning described above.

(3) A cleaning step in which the following sub-steps are carried out in sequence: ethanol/ultrasonic cleaning described above, sulfuric acid cleaning to immerse the nozzle plate 60 in a sulfuric acid solution (for example, SH-303 made by Kanto Chemical), and then cleaning with Frontier Cleaner A02 (made by Kanto Chemicals).

However, the cleaning step is not limited to those described above and can be altered suitably in accordance with the extent of soiling of the nozzle plate surface.

<Hydrogen Termination Step>

Next, hydrogen terminations are formed on the nozzle plate surface of the cleaned nozzle plate 60 from which impurities have been removed. The hydrogen termination step can use a wet process or a dry process.

(1) A wet process is carried out by immersing the nozzle plate 60 made of the material containing silicon in an aqueous HF solution (hydrofluoric acid solution) in a nitrogen atmosphere. Thereby, hydrogen atoms are bonded to silicon atoms on the nozzle plate surface, as in the hydrogen-terminated silicon shown on the left-hand side in FIG. 5A. In this case, if there is an oxide film (not shown) on the nozzle plate surface, then desirably, the concentration of the aqueous HF solution is adjusted suitably in accordance with the thickness of the oxide film. For example, if the oxide film is of the order of a natural oxide film, then the hydrogen termination process can be carried out by immersion for about 10 minutes in an aqueous HF solution diluted 200 (water) to 1 (HF) by mass ratio. It is also possible to carry out the hydrogen termination process in an ammonium fluoride solution, rather than an aqueous HF solution. Characteristic features of the wet process are that it enables processing at relatively low temperature, the process is easy to handle, and the process costs are low. However, the effects of contamination must be taken into account.

(2) A dry process is carried out by applying a hydrogen plasma treatment to the nozzle plate surface. For example, if a dry process is carried out on the nozzle plate surface bearing a natural oxide film, then a hydrogen plasma generated at a gas pressure of 10 mTorr and microwave input power of 200 W is irradiated onto the nozzle plate surface for 10 minutes. Thereby, hydrogen atoms are bonded to silicon atoms on the nozzle plate surface, as in the hydrogen-terminated silicon shown on the left-hand side in FIG. 5A. In this case, no oxygen and carbon peaks are detected by XPS (X-ray Photoelectron Spectroscopy) measurement on the nozzle plate surface after the termination step, and then it can be told that the natural oxide film and the carbon contaminating layer on the nozzle plate surface have been successfully removed by carrying out the termination step. When a sample subjected to the hydrogen termination by the dry process and a sample subjected to the hydrogen termination by the wet process using an aqueous HF solution are left under atmospheric conditions, the progress of natural oxidization and carbon contamination are substantially equal, and hence with the hydrogen plasma treatment, it is possible to create hydrogen terminations similarly to an aqueous HF solution. Details of the hydrogen plasma treatment can be found in the Osaka Prefecture University Doctoral Thesis "Research into technology for detecting faults in silicon crystals using plasma process, and cleaning of silicon surfaces", by Kenji Nakajima. Characteristic features of the dry process are that it is little affected by contamination, and a flat surface at the atomic level can be obtained by controlling the temperature of the nozzle plate 60.

<Liquid-Repellent Film Forming Step>

The liquid-repellent film forming step in the present embodiment differs from a method of forming a liquid-repellent film by means of a silane coupling agent, which creates siloxane bonds with the oxide film (hydroxyl groups) on a nozzle plate surface, in that a liquid-repellent film is formed directly by silicon-carbon bonding on the nozzle plate surface without an intervening oxide film.

As shown in FIG. 5A, silicon radicals (dangling bonds) are created by applying energy to the surface of the hydrogen-terminated silicon (or halogen-terminated silicon) formed in the hydrogen termination step so as to draw out hydrogen atoms (or halogen atoms) having been bonded to silicon atoms. Energy is applied to the hydrogen terminated nozzle plate surface either by heating, irradiation of ultraviolet or visible light, or introduction of a reaction initiator, or the like. For a reaction initiator, it is possible to use diacyl peroxide, for example.

Next, as shown in FIG. 5B, a radical reaction is carried out by causing a raw material of the liquid-repellent film having unsaturated carbon bonds at the ends and also having liquid-repellent functional groups (in FIGS. 5A and 5B, indicated as 1-alkene; the liquid-repellent functional group is present in the R part) to make contact with the nozzle plate surface in which silicon radicals have been produced.

Each molecule constituting the raw material of the liquid-repellent film used in the present embodiment has an unsaturated carbon bond at one end, more specifically contains a double bond or triple bond, and desirably, has a carbon-carbon double bond. For example, it is suitable to use a material having an $R—CH{=}CH_2$ chemical structure, where R is a hydrocarbon group and may have a liquid-repellent functional group. In this case, desirably, the liquid-repellent functional group is situated on the opposite side to the unsaturated carbon bond end, and more desirably, R has a fluorocarbon straight chain or branch chain. Each molecule constituting the desirable fluorocarbon raw material has an unsaturated carbon bond, and also has a fluoro functional group displaying liquid-repellent properties on the opposite side. Examples of the suitable fluorocarbon raw material include: perfluorohexyl ethylene, $CF_3(CF_2)_5CH{=}CH_2$; 1H, 1H, 2H-heptadecafluoro-1-decene, $F_3C(CF_2)_7CH{=}CH_2$; 3,3,4,4,5,5,6,6,6-nonafluoro-1-hexene, $CF_3(CF_2)_3CH{=}CH_2$; and the like.

For example, as shown in FIG. 5B, if silicon radicals on the nozzle plate surface react with 1-alkene molecules containing vinyl groups, then firstly, silicon radicals and alkenes react with each other, and silicon-carbon covalent bonds are formed. Carbon radicals which are simultaneously produced draw out hydrogen atoms from the adjacent Si—H groups, thereby generating further silicon radicals and causing a chain reaction to proceed. Thus, the nozzle plate surface is coated with the liquid-repellent film 62. Since the continuous chain reaction automatically halts when the formation of the liquid-repellent film 62 on the hydrogen terminated nozzle plate surface has ended, then it is possible to form the liquid-repellent film 62 as an extremely thin monolayer, i.e., single molecular layer on the nozzle plate surface of the nozzle plate 60.

Moreover, if a silicon-carbon bonding film is formed as an underlying film on the nozzle plate surface, and ultraviolet irradiation or ozone exposure is performed on this film, then the uppermost surface of the film is rendered hydrophilic, and therefore it is possible to form the liquid-repellent film 62 over the silicon-carbon bonding film. Furthermore, it is also possible firstly to form a plasma polymerization film (not shown) on the nozzle plate surface and then to form the liquid-repellent film 62 over this plasma polymerization film.

As the method for bringing the raw material of the liquid-repellent film into contact with the nozzle plate 60, it is possible to employ a wet process in which the nozzle plate 60 is immersed in a solution of the raw material of the liquid-repellent film (the solution of the raw material of the liquid-repellent film may be dissolved in an non-aqueous organic solvent), or a dry process such as vapor deposition or chemical vapor deposition (CVD).

<Final Cleaning Step>

Lastly, the nozzle plate 60 on which the liquid-repellent film 62 based on silicon-carbon bonding has been formed is finally cleansed with pure water, ethanol, or the like, thereby ending the liquid-repellent film forming process.

In the liquid-repellent film forming method described above, the embodiment where hydrogen terminations are formed has been described; however, it is also possible to use halogen-terminated silicon rather than hydrogen-terminated silicon. Hydrogen-terminated silicon is desirable from the viewpoint of the ease of film formation and preventing contamination, and the like.

The liquid-repellent film 62 formed by the liquid-repellent film forming method according to the present embodiment has the following beneficial effects.

(1) The liquid-repellent film 62 that is bonded directly to the nozzle plate surface through silicon-carbon bonds is able to improve resistance to liquids of various kind, such as liquids containing alkaline, acidic or neutral water-soluble components, and non-water-soluble liquids, compared to a liquid-repellent film as in the related art based on silicon-oxygen bonds, which are liable to be hydrolyzed in liquids containing OH groups, for example, water, or water-soluble components having alkaline properties. Consequently, it is possible to improve the ejection stability and the maintenance properties of the liquid-repellent film 62 for an inkjet head.

(2) Furthermore, since the liquid-repellent film 62 formed by the liquid-repellent film forming method of the present embodiment is a monolayer having high durability with respect to the liquids of various types, then very high smoothness of the liquid-repellent film 62 can be achieved. Since the liquid-repellent film 62 has high smoothness, then ink is not liable to adhere to the periphery of the nozzle apertures 51 and the ejection stability of the ink droplets is improved yet further. In addition to this, by forming the liquid-repellent film 62 as a very thin molecular film, it is also possible to reduce the amount of raw material used, and hence cost savings can be made. Although the thickness of the liquid-repellent film 62 varies depending on the raw material of the liquid-repellent film, if 1-hexadecene is used as the raw material of the liquid-repellent film, then the thickness of the monolayer liquid-repellent film 62 is approximately 3 nm or less, as measured by spectral ellipsometry.

On the other hand, in the liquid-repellent film described in Japanese Patent Application Publication No. 2008-105231, the liquid-repellent properties are improved by making the liquid-repellent film a thick film, but the thicker the film, the greater the surface roughness of the film, and therefore, the worse the ink ejection stability becomes.

EXAMPLES

Practical Example A

In Practical Example A hereby described, a liquid-repellent film was actually formed on a surface of a nozzle plate by means of the liquid-repellent film forming method according to the present invention, but the present invention is not limited to this example.

A pressure-resistant glovebox with hermetic sealing capability was prepared and the required experimental equipment was placed therein, whereupon the interior of the glovebox was filled with nitrogen. The experimenters carried out all of the following experiments using the rubber gloves of the glovebox.

Firstly, a solution of the raw material (1-hexadecene) of the liquid-repellent film was prepared, whereupon the solution was bubbled with impurity-free nitrogen gas to remove the dissolved oxygen in the solution.

On the other hand, a nozzle plate (with a natural oxide film thereon) which had undergone cleaning in a cleaning step was subjected to a hydrogen termination process by immersion in an aqueous HF solution diluted at a ratio of 200 (water) to 1 (HF). Although it is possible to carry out the hydrogen termination process before introduction in the glovebox, it is preferable to carry out this process inside the glovebox while taking carbon contamination and other factors into account. The cleaning process for the nozzle plate used the method (1) in the above-described cleaning step. The cleaning process according to method (2) or (3) may also be used.

Next, a liquid-repellent film forming step was carried out using two methods, namely, a heating method and an ultraviolet irradiation method.

<Liquid-Repellent Film Forming Step Using Heating Method>

A nozzle plate which had been subjected to a hydrogen termination process was placed inside a glass Petri dish, and a solution of the raw material of the liquid-repellent film, prepared as described above, was introduced into the dish and the nozzle plate was immersed therein, whereupon the dish was placed on a heater and heated to 100° C. to 200° C. Thereby, it was possible to form a liquid-repellent film based on silicon-carbon bonding on the surface of the nozzle plate. In this case, it is desirable that the heating temperature of the nozzle plate is appropriately adjusted in accordance with the type of solution of the raw material of the liquid-repellent film. For example, if the raw material of the liquid-repellent film is 1-hexadecene, then it is desirable to heat for about 3 hours to 5 hours at a temperature of approximately 150° C. to 180° C.

<Liquid-Repellent Film Forming Step Using Ultraviolet Light Irradiation Method>

A nozzle plate was introduced into a quartz cell and the interior of the cell was filled with a solution of the raw material of the liquid-repellent film. After sealing the cell with a rubber stopper, or the like, the nozzle plate was irradiated with ultraviolet light through the cell. The ultraviolet light irradiation conditions may be as follows, for example: using an ultra high pressure mercury vapor lamp, output of 70 $mW \cdot cm^{-2}$, and irradiation time of 1 hour to 20 hours. It is desirable that the irradiation time is appropriately adjusted in accordance with the thickness of the nozzle plate. Thereby, it was possible to form a liquid-repellent film based on silicon-carbon bonding on the surface of the nozzle plate.

Practical Example B

In Practical Example B, the surface stability (oxidization rate, carbon contamination, etc.) of a nozzle plate on which a liquid-repellent film had been formed by the heating method in Practical Example A was tested.

The test involved leaving the nozzle plate of Practical Example on which the liquid-repellent film had been formed in accordance with Practical Example A, at room temperature and atmospheric pressure for 350 hours. Alongside this, a nozzle plate of Comparative Example 1 which had only been subjected to a hydrogen termination process using hydrofluoric acid (an aqueous HF solution) was also left at room temperature and atmospheric pressure for 350 hours. The static angle of contact of pure water was measured over time, on the surface of the nozzle plate of Practical Example on which the liquid-repellent film had been formed, and on the surface of the nozzle plate of Comparative Example 1 which had undergone hydrogen termination.

Figure 6:
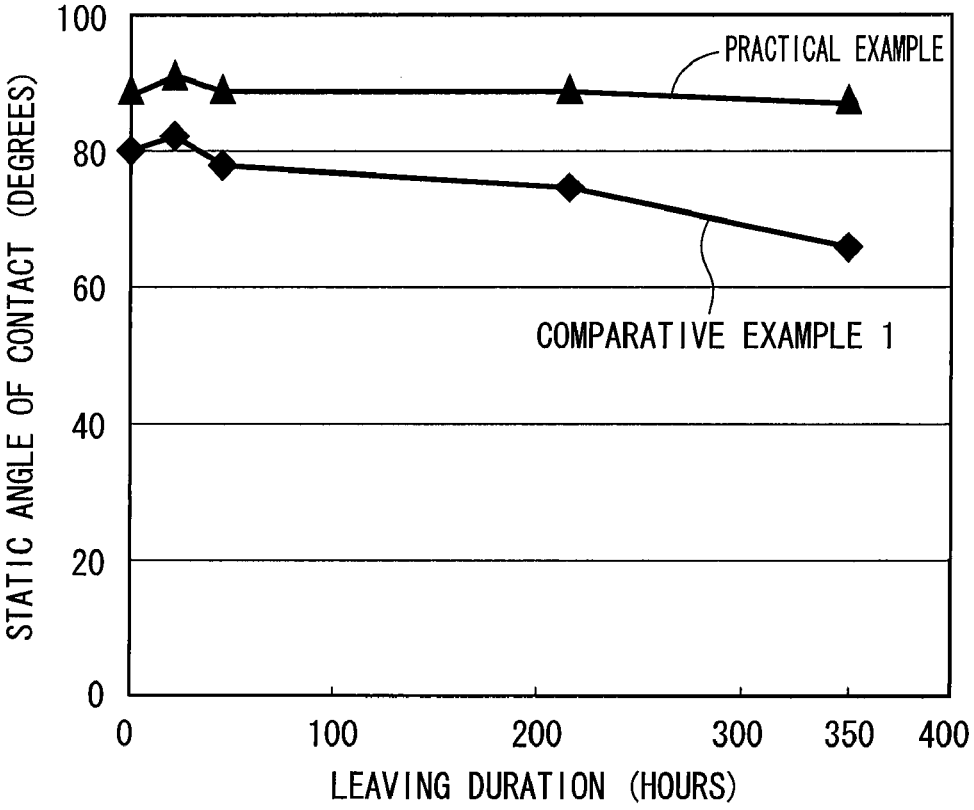
FIG. 6 is an explanatory diagram showing results of Practical Example testing the surface quality of a liquid-repellent film formed in an embodiment of the present invention.

FIG. 6 shows the corresponding results. As FIG. 6 reveals, with the nozzle plate Comparative Example 1, oxidization progressed and the static angle of contact declined with the passage of time, whereas with the nozzle plate of Practical Example, the static angle of contact hardly changed at all and a stable surface was formed.

Practical Example C

In Practical Example C, the alkali resistance was compared, as one example of liquid resistance, between a nozzle plate of Practical Example on which the liquid-repellent film based on silicon-carbon bonds had been formed in accordance with Practical Example A, and a nozzle plate of Comparative Example 2 having a liquid-repellent film based on siloxane bonds (Si—O).

In order to strengthen siloxane bonds, the liquid-repellent film of Comparative Example 2 was formed by firstly forming a $SiO_2$ film as an underlying film by CVD on the surface of the nozzle plate, as in Japanese Patent Application Publication No. 2009-029068 described above. Then, a fluorocarbon liquid-repellent film material containing chlorosilane as a reactive group was caused to react with the underlying film also by a CVD method, to form a liquid-repellent film bonded to the nozzle plate through siloxane bonds.

<Ink Immersion Test>

Two samples, the nozzle plate of Practical Example and the nozzle plate of Comparative Example 2 formed as described above were immersed respectively for 100 hours at room temperature in water-soluble inks of three types, namely, inks 1 to 3 having the compositions indicated below. All of the water-soluble inks were alkaline and had the pH of about 9.0.

<<Composition of Ink 1>>

Cyan dispersion liquid 1: 3 wt % (by pigment concentration)
Resin particles dispersion P-2: 7 wt %
Sannix GP-250 (made by Sanyo Chemical Industries): 10 wt %
Tripropylene glycol monomethyl ether: 10 wt %
Olefin E1010 (surfactant made by Nisshin Chemicals): 1 wt %
Deionized water: Remainder <<Composition of ink 2>>

Cyan dispersion liquid 1: 2 wt % (by pigment concentration)
Resin particles dispersion P-2: 8 wt %
Sannix GP-250 (made by Sanyo Chemical Industries): 8 wt %
Tripropylene glycol monomethyl ether: 8 wt %
Olefin E1010 (surfactant made by Nisshin Chemicals): 1 wt %
Deionized water: Remainder <<Composition of ink 3>>

Cyan dispersion liquid 1: 4 wt % (by pigment concentration)
Resin particles dispersion P-2: 7 wt %
Sannix GP-250 (made by Sanyo Chemical Industries): 9 wt %
Tripropylene glycol monomethyl ether: 9 wt %
Olefin E1010 (surfactant made by Nisshin Chemicals): 1 wt %
Deionized water: Remainder The static angles of contact of unused inks with respect to the liquid-repellent films of Practical Example and Comparative Example 2 were measured both initially (before immersion) and after immersion for 100 hours, using the water-soluble inks 1-3 having the above-described compositions.

The corresponding results were represented as an amount of change in the angle of contact indicated below, thereby enabling a comparison of alkaline resistance between Practical Example and Comparative Example 2:

"amount of change in angle of contact"(%)={("initial angle of contact"−"angle of contact after immersion")/"initial angle of contact"}×100.

Experimental Results

The amount of change in the angle of contact of the liquid-repellent film applied on the nozzle plate of Comparative Example 2 was 22.6%, whereas the amount of change in the angle of contact of the liquid-repellent film applied on the nozzle plate of Practical Example was 1.4%. These results reveal that the liquid-repellent film bonded to the nozzle plate through silicon-carbon bonds has dramatically improved alkaline resistance compared to the liquid-repellent film bonded to the nozzle plate through silicon-oxygen bonds. In particular, since the liquid-repellent film bonded through silicon-carbon bonds is a self-assembled monolayer and is able to display high resistance to alkalis with an extremely thin film, it is possible to reduce the effects on dimensional accuracy on the nozzle apertures, even if the liquid-repellent film is formed on the nozzle plate surface.

The present invention is able to improve durability with respect not only to pigment or dye-based inks but to alkaline solutions of various types in general.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of forming a liquid-repellent film on a surface of a nozzle plate having nozzle apertures through which droplets of liquid are ejected, the method comprising:

a nozzle plate preparation step of preparing a nozzle plate, at least a portion of a surface of the nozzle plate being made of a material containing silicon;

a termination process step of carrying out one of a hydrogen termination process and a halogen termination process on the surface of the nozzle plate; and a liquid-repellent film formation step of forming a liquid-repellent film on the surface of the nozzle plate after the termination process step by bringing a liquid-repellent film raw material into contact with the surface of the nozzle plate while applying energy to the surface of the nozzle plate, each molecule constituting the liquid-repellent film raw material having an unsaturated carbon bond at an end and having a liquid-repellent functional group, the liquid-repellent film being bonded to the surface of the nozzle plate through silicon-carbon bonds.

2. The method as defined in claim 1, wherein in the termination process step, the hydrogen termination process in which the nozzle plate is immersed in a solution containing one of hydrofluoric acid and ammonium fluoride is carried out.

3. The method as defined in claim 1, wherein in the termination process step, the hydrogen termination process in which the nozzle plate is plasma treated with a plasma of hydrogen is carried out.

4. The method as defined in claim 1, wherein in the liquid-repellent film formation step, heat is applied to the surface of the nozzle plate as the energy.

5. The method as defined in claim 1, wherein in the liquid-repellent film formation step, one of ultraviolet light and visible light is applied to the surface of the nozzle plate as the energy.

6. The method as defined in claim 1, further comprising a cleaning step of removing impurities from the surface of the nozzle plate before the termination process step.

7. The method as defined in claim 1, wherein in each molecule constituting the liquid-repellent film raw material, the liquid-repellent functional group is located on an end opposite to the end having the unsaturated carbon bond.

8. The method as defined in claim 1, wherein in each molecule constituting the liquid-repellent film raw material, the liquid-repellent functional group includes at least one of a fluorocarbon straight chain and a fluorocarbon branch chain.

9. The method as defined in claim 1, wherein the liquid-repellent film raw material includes perfluorohexyl ethylene.

10. The method as defined in claim 1, wherein the liquid-repellent film raw material includes 1H, 1H, 2H-heptadecafluoro-1-decene.

11. The method as defined in claim 1, wherein the liquid-repellent film raw material includes 3,3,4,4,5,5,6,6,6-nonafluoro-1-hexene.

12. The method as defined in claim 1, wherein the nozzle plate is provided on an inkjet head which ejects droplets of ink.

* * * * *